US005743078A

United States Patent [19]

Doornaert et al.

[11] Patent Number: 5,743,078

[45] Date of Patent: Apr. 28, 1998

[54] M+N STEEL CORD WITH EQUAL PLE PER FILAMENT

[75] Inventors: Ghislain Doornaert, Marke; Yvan A. Lippens, Vichte, both of Belgium

[73] Assignee: N.V. Bekaert S.A., Zwevegem, Belgium

[21] Appl. No.: 813,967

[22] Filed: Mar. 3, 1997

[30] Foreign Application Priority Data

Mar. 11, 1996 [EP] European Pat. Off. ..... 96200660

[51] Int. Cl.[6] ..... D02G 3/36; D02G 3/02

[52] U.S. Cl. ..... 57/902; 57/9; 57/212; 57/237; 57/311

[58] Field of Search ..... 57/9, 212, 218, 57/237, 311, 902

[56] References Cited

U.S. PATENT DOCUMENTS

| | | | |
|---|---|---|---|
| 4,408,444 | 10/1983 | Baillievier | 57/237 |
| 5,285,623 | 2/1994 | Baillievier et al. | 57/236 |
| 5,581,990 | 12/1996 | Van Giel et al. | 57/311 |
| 5,661,966 | 9/1997 | Matsumaru | 57/902 |

FOREIGN PATENT DOCUMENTS

| | | |
|---|---|---|
| 0 466 720 | 1/1992 | European Pat. Off. . |
| 4-370283 | 12/1992 | Japan . |
| 7-42089 | 2/1995 | Japan . |

OTHER PUBLICATIONS

Abstract of JP 6-73672, Pub. No. 94-124456/15.

*Primary Examiner*—William Stryjewski
*Attorney, Agent, or Firm*—Foley & Lardner

[57] ABSTRACT

A steel cord (30) consists of a first group and a second group. The first group comprises two or more plastically deformed outer steel filaments (10) twisted around each other with a first twist pitch and the second group comprises one or more plastically deformed inner steel filaments (20) twisted around each other with a second twist pitch. The second group is twisted around the first group with a cord twist pitch. One of the inner or the outer steel filaments having a part load elongation of x %, all the other inner and outer steel filaments having a part load elongation of y %, whereby x and y fulfil the equation:

$$x-0.10 \leq y \leq x+0.10,$$

and where all the inner and outer steel filaments have a deforming pitch that is substantially equal to the cord twist pitch.

9 Claims, 1 Drawing Sheet

M+N STEEL CORD WITH EQUAL PLE PER FILAMENT

FIELD OF THE INVENTION

The present invention relates to a steel cord consisting of a first group and a second group. The first group comprises two or more outer steel filaments twisted around each other with a first twist pitch which may be infinite. The second group comprises one or more inner steel filaments twisted around each other with a second twist pitch. The second group is twisted around the first group with a cord twist pitch. Such a steel cord will hereinafter be referred to as an "m+n-cord".

The invention also relates to a way of manufacturing an m+n-cord. As will be explained hereunder, the terms 'outer' steel filaments and 'inner' steel filaments are used to distinguish clearly between the two groups and refer more to the way of manufacturing the invention steel cord than to the exact position of the respective steel filaments in a transversal cross-section of the final steel cord.

The number of outer steel filaments is m, the number of inner steel filaments is n.

BACKGROUND OF THE INVENTION

An m+n-cord has been disclosed in U.S. Pat. No. 4,408,444 and has been widely used on a world-wide scale, especially as a reinforcement for the breaker layer of radial passenger tires and truck tires. Advantages of this m+n-cord are a complete rubber penetration and an economical way of manufacturing: it can be made in one single twisting step of a double-twister.

In spite of this commercial success, this prior art m+n-cord may present some imperfections such as a rather moderate level of fatigue resistance, a relatively low weldability and the fact that the cord may cause some processability problems especially in highly automated systems of tire manufacturing.

The prior art has already recognized the problem of the moderate level of fatigue resistance but has not yet recognized the problem of weldability and the problem of processability.

EP-A-0 466 720 teaches a first way of improving the fatigue resistance by differentiating the diameter of the outer steel filaments of the first group from the diameter of the inner steel filaments of the second group. The result is an m+n-cord with an improved fatigue resistance but where two different filament diameters are required. This necessitates a more expensive way of manufacturing and involves the risk that the different filaments may be erroneously exchanged on the manufacturing floor.

JP-A-06-073 672 and JP-A-07-042089 disclose a second way of improving the fatigue resistance of an m+n-cord by superposing to the m outer steel filaments of the first group a plastic undulation such as a crimp form, obtained by means of two toothed wheels, or a helicoidal form, obtained by means of a rotating preforming pin.

Although the fatigue resistance has increased by 30%, this m+n-steel cord has gaps between the outer steel filaments as a consequence of the undulation, which results in a steel cord with a great part load elongation and in a steel cord which is rather loose in structure. Another drawback of this m+n-cord is that a further increase of fatigue resistance is almost excluded if the undulation is a crimp form since the toothed wheels used in obtaining the crimp form may harm the surface layer of the steel filaments. If, on the other hand, the undulation is a helicoidal form, the preforming pin must be driven by an external and additional energy source, which means a more expensive way of manufacturing.

SUMMARY OF THE INVENTION

It is an object of the present invention to improve the fatigue resistance of existing m+n-cords.

It is another object of the present invention to improve the weldability of m+n-cords.

It is a further object of the present invention to improve the processability of m+n-cords by avoiding flare and by improving the straightness.

According to a first aspect of the present invention, there is provided for a steel cord which consists of a first group and a second group. The first group comprises two or more (i.e. the number m) plastically deformed outer steel filaments twisted around each other with a first twist pitch. The second group comprises one or more (i.e. the number n) plastically deformed inner steel filaments twisted around each other with a second twist pitch. The second group is twisted around the first group with a twist pitch which is the cord twist pitch and forms in this way an m+n-cord.

All the inner and outer filaments have a part load elongation which is substantially equal to each other. This means that one of the inner or the outer steel filaments has a part load elongation of x %, and that all the other inner and outer steel filaments having a part load elongation of y %, wherein x and y fulfil the equation:

$$x-0.10 \leqq y \leqq x+0.10$$

and preferably fulfil the following equation:

$$x-0.05 \leqq y \leqq x+0.05.$$

In addition thereto, all the inner and outer steel filaments have a deforming pitch that is substantially equal to the cord twist pitch.

The part load elongation or PLE of a steel filament is defined as the increase in length of the steel filament, which results from subjecting the steel filament to a defined force—usually between 20 and 100 Newton, normally 50 Newton although 20 Newton is also used—and is expressed as a percentage of the initial length of the steel filament measured under a defined pre-tension.

The part load elongation of a steel filament is to be distinguished from the part load elongation or PLE of a steel cord which is defined as the increase in length of the steel cord, which results from subjecting the steel cord to a defined force—usually between 20 and 100 Newton—and is expressed as a percentage of the initial length of the steel cord measured under a defined pre-tension (of usually 2.5 Newton).

The feature that all the inner and outer steel filaments have a deforming pitch that is substantially equal to the cord twist pitch allows to apply a deforming technique that is simple and economical and that avoids the creation of micro-gaps.

Preferably the steel cord as a whole has a part load elongation that is smaller than 0.25%, e.g. smaller than 0.20%.

Preferably the steel filaments of the first group and the steel filaments of the second group have line contacts between each other.

Preferably the second twist pitch is equal to the cord twist pitch and the first twist pitch is greater than 300 mm or has an infinite value.

Examples of m+n-steel cord constructions according to the invention are: 2+1, 2+2, 3+2, 2+3, 3+3.

According to a second aspect of the present invention there is provided for a method of manufacturing a steel cord by means of a double-twister. The steel cord consists of a first group of one or more outer steel filaments and of a second group of one or more inner steel filaments. The method comprises as steps:

(a) supplying the outer steel filaments from supply spools located at the outer side of the twister;

(b) twisting the outer steel filaments in a first direction to form the first group;

(c) supplying the inner steel filaments from supply spools located at the inner side of the twister;

(d) plastically deforming the outer steel filaments to a first degree;

(e) plastically deforming the inner steel filaments to a degree lower than the first degree;

(f) twisting the inner steel filaments in a second direction opposite to the first direction to form the second group, while untwisting the outer steel filaments in the first group and twisting the second group around the first group, so as to form a final steel cord;

(g) winding the final steel cord on a spool.

BRIEF DESCRIPTION OF THE DRAWINGS

A preferable embodiment of the invention will now be described into more detail with reference to the accompanying drawings wherein.

DESCRIPTION OF THE PREFERRED EMBODIMENTS OF THE INVENTION

Figure 1:
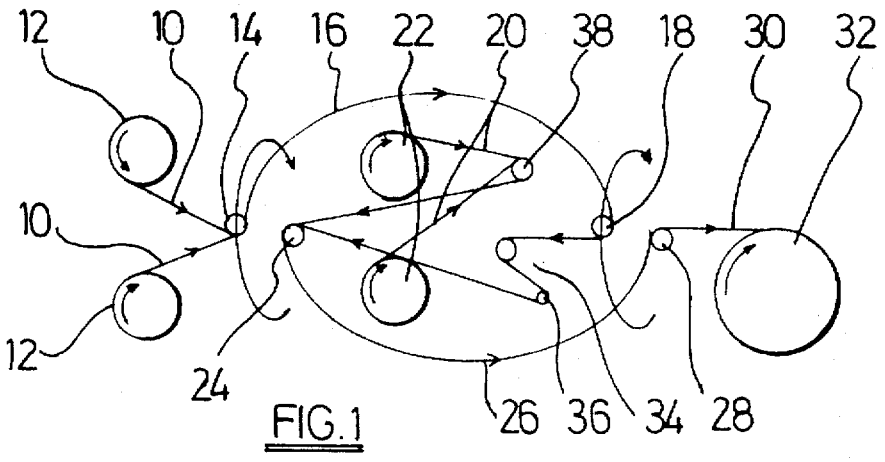
FIG. 1 shows a way of manufacturing an m+n-cord according to the invention.

FIG. 1 illustrates schematically a way of manufacturing an m+n-cord according to the invention. Referring to the same FIG. 1, however, the convenient way of manufacturing a prior art m+n-cord will be first explained, and thereafter, the differences with this convenient way will be highlighted.

Starting from the left side of FIG. 1, two outer steel filaments 10 are unwound from supply spools 12 and are guided towards a reversing pulley 14, where the two outer steel filaments 10 receive a first twist in the S-direction. The thus partially twisted outer steel filaments 10 are further guided over a first rotating flyer 16 towards a reversing pulley 18 where they receive a second twist in the S-direction.

Two inner steel filaments 20 are unwound from inner supply spools 22 and are guided towards a reversing pulley 24 where the inner steel filaments 20 are brought together with the twisted outer steel filaments 10. Here both the outer steel filaments 10 and the inner steel filaments 20 receive a twist in the Z-direction. For the outer steel filaments 10 this means that they are partially untwisted. Both the outer steel filaments 10 and inner steel filaments 20 are guided over a second rotating flyer 26 towards a reversing pulley 28 where both the outer steel filaments 10 and the inner steel filaments 20 receive a second twist in the Z-direction. This means that the outer steel filaments 10 are completely untwisted and that the inner steel filaments 20 are twisted to their final degree in Z-direction. The final cord 30 is wound on spool 32.

Summarizing the above process for the outer steel filaments 10, outer steel filaments are guided over two rotating flyers and over four reversing pulleys. They receive first twists in S-direction and are subsequently untwisted by twists in Z-direction. Due to the fact that the outer steel filaments already receive a twist at the level of reversing pulley 14 and that the outer steel filaments are untwisted in the final cord, more length is taken from outer supply spools 12 than is really necessary, which results in great variations of the straightness of the cord and in resulting processability problems.

Summarizing the above process for the inner steel filaments 20, inner steel filaments are guided over only one rotating flyer and over only two reversing pulleys. They receive only twists in Z-direction. Due to the fact that the inner steel filaments only receive one twist at the level of reversing pulley 24 and that the inner steel filaments are twisted twice in the final cord, less length is taken from the inner supply spools 20 than is required, which results again in great variations of the straightness of the cord and in internal tensions in the cord.

This means that the outer steel filaments undergo substantially different twists and substantially different bending deformations than the inner steel filaments. The substantially different twists result in a substantially different torsion diagrams and in substantially different levels of residual torsions between the inner and outer steel filaments, which causes flare to the final m+n-cord, this is the spreading of the ends of the steel filaments after cutting of the m+n-cord. Flare may result in significant processability problems.

The substantially different twists and bendings result also in a substantially different deformation degree between the inner steel filaments and the outer steel filaments, which may result in an unequal loading of the steel filaments and in an unacceptable low degree of straightness.

The inventors have now anticipated this different processing of outer steel filaments and inner steel filaments by subjecting the outer steel filaments to greater plastical bending degree than the inner steel filaments.

More particularly, returning to FIG. 1, when leaving reversing pulley 18, the outer steel filaments 10 are guided over guiding pulley 34 and are bent over a deforming pin 36 before being guided towards reversing pulley 24. The inner steel filaments 20 are bent over a deforming pin 38 before being brought together with outer steel filaments 10. The diameter of deforming pin 36 is smaller than the diameter of deforming pin 38, which results in a greater curvature and bending deformation given to the outer steel filaments 10 than to the inner steel filaments 20.

This way of differentiating the bending given to the outer steel filaments from the bending given to the inner steel filaments is exactly the opposite of the teaching in JP-A-04-370 283, where the inner steel filaments are given a deformation that is more than the deformation given to the outer steel filaments.

The proper values of the diameters of the deforming pins 36 and 38 may be determined according to following method. The value of the diameter of deforming pin 38 for the inner steel filaments 20 is arbitrarily set to a determined value. The value of the diameter of deforming pin 36 is then decreased gradually until the part load elongation of the inner steel filaments matches about the part load elongation of the outer steel filaments. In case not such a match is found, the whole process starts again for another value of the diameter of deforming pin 38. In the example of a 2×0.25+2×0.25-cord with a lay length of 14 mm, 14 mm for diameter of deforming pin 38 and 11 mm for diameter of deforming pin 36 may form a best fit. For another value of the diameter of deforming pin 36, another value of the diameter of deforming pin 38 may form the best fit.

Figure 2:
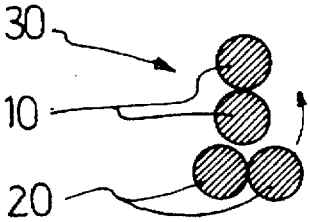
FIG. 2, FIG. 3 and FIG. 4 show transversal cross-sections of m+n-cords.
Figure 3:
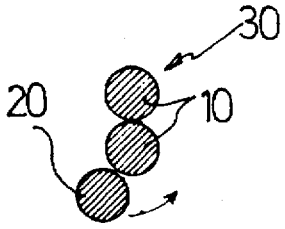
Figure 4:
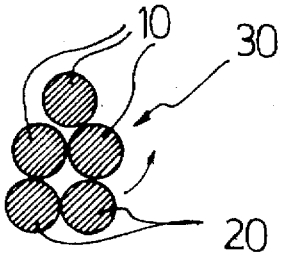

FIGS. 2, 3 and 4 show respectively transversal cross-sections of a 2+2-cord, a 2+1-cord and a 3+2-cord according to the invention. These transversal cross-sections show contacts between the outer steel filaments 10 and contacts between the inner steel filaments, which means that over the length of the cord there are mainly line contacts between the filaments and no gaps substantially greater than about the length of the twist pitch are formed between the inner steel filaments and between the outer steel filaments. This rather compact structure results in a low part load elongation of the invention steel cord (below 0.20% and preferably below 0.18%) and thus in an increased structural stabilty.

Figure 5:
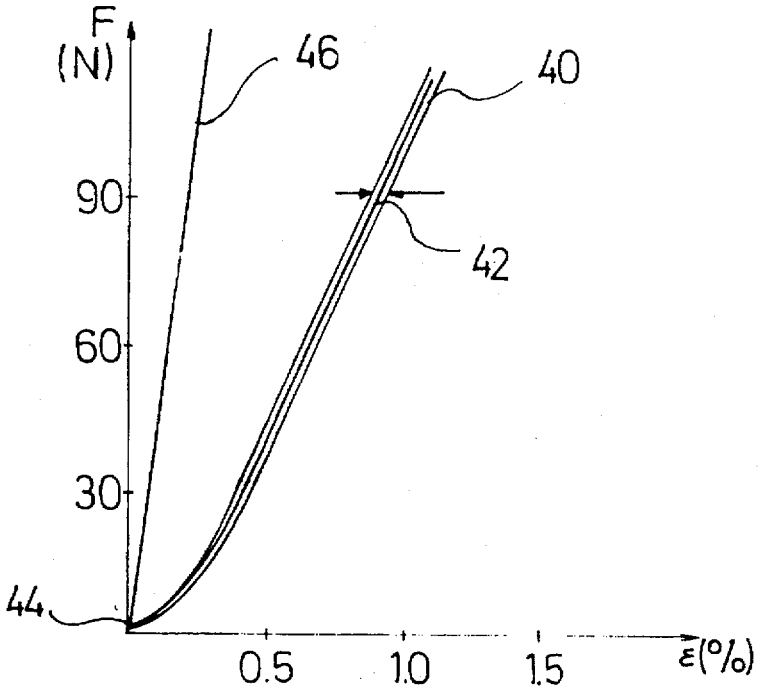
FIG. 5 shows a load-elongation diagram of a m+n-cord according to the invention.

FIG. 5 shows a load-elongation curve of a 2×0.30+2×0.30-cord according to the invention. The applied load F is in the ordinate and is expressed in Newton, the elongation is in abscissa and is expressed in per cent. The part load elongation curves 40 of the two inner and the two outer steel filaments all lie within a very small range 42 of at most 2×0.10%. This is true for all loads between a pretension 44 of 2.5 Newton and 120 Newton. Curve 46 indicates the part load elongation of the whole 2×0.30+2×0.30-cord.

A prior art 2×0.25+2×0.25-cord according to U.S. Pat. No. 4,408,444 has been compared with a 2×0.25+2×0.25-cord according to the present invention. The table hereunder summarizes the results.

TABLE

| | 2 + 2 × 0.25 prior art | 2 + 2 × 0.25 invention |
|---|---|---|
| cord twist pitch (mm) | 14 | 14 |
| rubber penetration (%) | 100 | 100 |
| part load elongation (PLE) cord (%) | 0.169 | 0.166 |
| part load elongation (PLE) of | | |
| outer steel filaments | 0.581 | 0.674 |
| inner steel filaments | 0.684 | 0.687 |
| maximum difference in PLE between outer and inner steel filaments (%) | 0.103 | 0.013 |
| fatigue resistance In dry conditions (number of cycles) | 50543 | 109253 |
| fatigue resistance in wet conditions (number of bendings) | 40086 | 137621 |
| flare (number of observations) | 3/25 | 0/25 |
| variance of arc height (variance of 25 samples) | 11.8 | 5.7 |
| weldability (breaking load of weld/ average of 25 samples - in Newton) | 245.6 | 280.6 |

The rubber penetration has been determined by the pressure-drop method on a steel cord sample of 13 mm embedded in rubber cylinder.

The fatigue resistance has been determined by subjecting a test specimen to an alternate bending test.

The table reflects only a small difference in PLE between inner steel filaments and outer steel filaments for the invention cord. The table further shows a remarkable improvement in fatigue resistance (fatigue level has more than doubled), in straightness (lower variance in the values of arc height, i.e. more consistency in the values of the arc height), in flare behaviour and in weldability.

The improved weldability can be explained by taking a look at the way of welding two cord ends together. The to-be-welded cord ends are twisted to a small pitch. If, as is the case with the invention cord, the PLE is about equal for all steel filaments, i.e. for both outer and inner steel filaments, the cord is smooth, alignment of the two twisted cord ends is easy and all filaments will contribute in substantially the same way to the breaking load of the weld. If the PLE is different for the steel filaments, the ends are twisted in a roughened way, alignment is difficult and the steel filaments do not contribute in the same way to the breaking load of the weld.

In addition to the above-mentioned characteristics and properties, an m+n-cord according to the present invention may have following features which make it suitable for the reinforcement of elastomers such as rubber tires:

the filament diameters range from 0.04 mm to 1.1 mm, more specifically from 0.15 mm to 0.60 mm, e.g. from 0.20 mm to 0.45 mm;

the steel composition generally comprises a minimum carbon content of 0.60% (e.g. at least 0.80%, with a maximum of 1.1%), a manganese content ranging from 0.20 to 0.90% and a silicon content ranging from 0.10 to 0.90%; the sulphur and phosphorous contents are preferably kept below 0.03%; additional elements such as chromium (up to 0.2 à 0.4%), boron, cobalt, nickel, vanadium . . . may be added to the composition;

the filaments are conveniently covered with a corrosion resistant coating such as zinc or with a coating that promotes the adhesion to the rubber such as brass, or a so-called ternary brass such as copper-zinc-nickel (e.g. 64%/35.5%/0.5%) and copper-zinc-cobalt (e.g. 64%/35.7%/0.3%), or a copper-free adhesion layer such as zinc-cobalt or zinc-nickel;

the tensile strength may vary between 2000 MPa (1 MPa=1 MegaPascal=1N/mm$^2$) and 4000 MPa or even higher.

We claim:

1. A steel cord (30) consisting of a first group and a second group, the first group comprising two or more plastically deformed outer steel filaments (10) twisted around each other with a first twist pitch, the second group comprising one or more plastically deformed inner steel filaments (20) twisted around each other with a second twist pitch, the second group twisted around the first group with a cord twist pitch, one of the inner or the outer steel filaments having a part load elongation of x %, all the other inner and outer steel filaments having a part load elongation of y %, x and y fulfilling the equation:

$$x-0.10 \leq y \leq x+0.10,$$

all the inner and outer steel filaments having a deforming pitch that is substantially equal to the cord twist pitch.

2. A steel cord according to claim 1 wherein the steel cord as a whole has a part load elongation that is smaller than 0.25%.

3. A steel cord according to claim 1 wherein the second twist pitch is equal to the cord twist pitch.

4. A steel cord according to claim 1 wherein the first twist pitch is greater than 300 mm.

5. A steel cord according to claim 1 wherein the first twist pitch is infinite.

6. A steel cord according to claim 1 wherein the first group consists of two steel filaments and the second group consists of one filament.

7. A steel cord according to claim 1 wherein the first group consists of two steel filaments and the second group consists of two steel filaments.

8. A steel cord according to claim 1 wherein the first group consists of three steel filaments and the second group consists of two steel filaments.

9. A steel cord according to claim 1 wherein the first group consists of three steel filaments and the second group consists of three steel filaments.

* * * * *